US006691315B1

(12) United States Patent
Clarke et al.

(10) Patent No.: US 6,691,315 B1
(45) Date of Patent: Feb. 17, 2004

(54) PROTECTIVE GLOVE FOR BOXERS

(76) Inventors: Vinson K. Clarke, 383 Preyer St., Shelby, NC (US) 28152; Lamont Gist, 383 Preyer St., Shelby, NC (US) 28152

( * ) Notice: Subject to any disclaimer, the term of this patent is extended or adjusted under 35 U.S.C. 154(b) by 0 days.

(21) Appl. No.: 10/266,216

(22) Filed: Oct. 7, 2002

(51) Int. Cl.[7] ..... A41D 13/00
(52) U.S. Cl. ..... 2/20; 2/18
(58) Field of Search ..... 2/16, 18, 20, 159, 2/160, 161.1, 161.4, 161.6, 162, 163, 164, 167, 169; 602/21, 22

(56) References Cited

U.S. PATENT DOCUMENTS 1,627,382 A * 5/1927 Golomb ..... 2/18
1,706,503 A * 3/1929 Travers ..... 2/18
2,567,489 A * 9/1951 Lewis ..... 2/20
3,037,209 A * 6/1962 Applegate, Jr. et al. ..... 2/20
3,890,649 A * 6/1975 Diggins ..... 2/20
4,067,063 A * 1/1978 Ettinger ..... 2/413
4,287,609 A * 9/1981 Amadeo ..... 2/16
4,400,829 A * 8/1983 Willis ..... 2/16
4,417,359 A * 11/1983 Johnson ..... 2/16
D280,569 S * 9/1985 Paulson ..... D29/113
4,947,486 A * 8/1990 Hsuih ..... 2/164
4,961,418 A * 10/1990 McLaurin-Smith ..... 602/21
4,967,419 A * 11/1990 Elliott ..... 2/16
5,079,776 A * 1/1992 Crawford ..... 2/20
5,295,269 A * 3/1994 Ballard ..... 2/18
5,498,234 A * 3/1996 Martel et al. ..... 602/21
5,572,738 A * 11/1996 Melone, Jr. ..... 2/16
5,640,712 A * 6/1997 Hansen et al. ..... 2/20
5,781,928 A * 7/1998 Avila ..... 2/16
6,013,044 A * 1/2000 Estwanik ..... 602/21
6,178,553 B1 * 1/2001 Bolton ..... 2/18
6,226,795 B1 * 5/2001 Winningham ..... 2/20
6,289,517 B1 * 9/2001 Minkow et al. ..... 2/161.1

* cited by examiner

*Primary Examiner*—Gary L. Welch

(57) ABSTRACT

Protective gloves for boxers are desirable for protecting the hands of boxers. Considerable stress is placed on the joints of the hand during the impact of a punch. The protective glove for boxers is secured to the hand using elastic bands around the digits of the hand and a wrist strap releasably secured by a hook and loop fastener. The chance of injury is reduced by the use of a flexible rubber pad to distribute force across the knuckles and a shock absorbing layer of cellular foam lining the interior of the glove. The protective glove for boxers can be applied by the user without assistance, and will not shift position during a fight.

19 Claims, 4 Drawing Sheets

PROTECTIVE GLOVE FOR BOXERS

BACKGROUND OF THE INVENTION

1. Field of the Invention

The present invention relates to a protective glove for boxers for use in connection with boxing. The protective glove for boxers has particular utility in connection with protecting a boxer's hand from injury.

2. Description of the Prior Art

Protective gloves for boxers are desirable for protecting the hands of boxers. Considerable stress is placed on the joints of the hand during the impact of a punch. Traditionally, tape has been wrapped about the hand to strengthen the wrist and hand. However, taping requires a lengthy process whose results are dependent on the skill and knowledge of the tape applier. Tape may shift during the progress of a fight, resulting in reduced effectiveness. Use of a protective glove for boxers eliminates the taping process, thereby allowing the boxer to apply hand protection without assistance. The protective glove for boxers will not shift during a fight, thereby providing full protection from injury to the hands at all times. The protective glove for boxers could also be decorated.

The use of hand and wrist stabilization devices is known in the prior art. For example, U.S. Pat. No. 6,013,044 to Estwanik discloses a hand and wrist stabilization device. However, the Estwanik '044 patent does not have a force dispersion pad made of flexible rubber, and has further drawbacks of lacking elastic bands around the digits of the hand.

U.S. Pat. No. 1,627,382 to Golomb discloses a protective device for boxers that protects the hands, knuckles, and wrists of the boxer. However, the Golomb '382 patent does not have a wrist strap, and additionally requires lacing in order to be secured to the hand.

Similarly, U.S. Pat. No. 1,706,503 to Travers discloses a boxer's hand protector that is designed for the protection of the hands and wrists. However, the Travers '503 patent does not have a force dispersion pad made of flexible rubber, and cannot be secured to the hand without lacing.

In addition, U.S. Pat. No. 5,295,269 to Ballard discloses a portable hand wrap that can be worn in all sports. However, the Ballard '269 patent does not have a force dispersion pad made of flexible rubber, and also does not have an elastic band around the thumb.

Furthermore, U.S. Pat. No. 4,287,609 to Amadeo discloses a protective hand wrap for athletes that protects the hands of athletes in sports such as boxing, football, and the like. However, the Amadeo '609 patent does not have a body portion, and further lacks elastic bands around the digits of the hand.

Continuing, U.S. Pat. No. 5,781,928 to Avila discloses a multi-purpose hand protector that protects the hands when struck in boxing. However, the Avila '928 patent does not have elastic bands around the digits of the hand, and lacks a force dispersion pad made of flexible rubber.

Lastly, U.S. Pat. No. Des. 280,569 to Paulson discloses a protective glove for a football player. However, the Paulson '569 patent does not have a force dispersion pad made of flexible rubber, and has the additional deficiency of lacking elastic bands around the digits of the hand.

While the above-described devices fulfill their respective, particular objectives and requirements, the aforementioned patents do not describe a protective glove for boxers that allows protecting a boxer's hand from injury. The Estwanik '044 patent, the Avila '928 patent, and the Paulson '569 patent make no provision for a force dispersion pad made of flexible rubber or elastic bands around the digits of the hand. The Golomb '382 patent and the Travers '503 patent require lacing to secure the glove to the hand. The Travers '503 patent and the Ballard '269 patent do not have a force dispersion pad made of flexible rubber. The Amadeo '609 patent lacks elastic bands around the digits of the hand.

Therefore, a need exists for a new and improved protective glove for boxers that can be used for protecting a boxer's hand from injury. In this regard, the present invention substantially fulfills this need. In this respect, the protective glove for boxers according to the present invention substantially departs from the conventional concepts and designs of the prior art, and in doing so provides an apparatus primarily developed for the purpose of protecting a boxer's hand from injury.

SUMMARY OF THE INVENTION

In view of the foregoing disadvantages inherent in the known types of hand and wrist stabilization devices now present in the prior art, the present invention provides an improved protective glove for boxers, and overcomes the above-mentioned disadvantages and drawbacks of the prior art. As such, the general purpose of the present invention, which will be described subsequently in greater detail, is to provide a new and improved protective glove for boxers which has all the advantages of the prior art mentioned heretofore and many novel features that result in a protective glove for boxers which is not anticipated, rendered obvious, suggested, or even implied by the prior art, either alone or in any combination thereof.

To attain this, the present invention essentially comprises a glove body covering the hand and wrist made of flexible fabric with a force dispersion pad mounted across at least a portion of the knuckles of a hand on which the glove is worn.

There has thus been outlined, rather broadly, the more important features of the invention in order that the detailed description thereof that follows may be better understood and in order that the present contribution to the art may be better appreciated.

The invention may also include the glove being shaped so that it leaves the fingers and thumb exposed. The force dispersion pad may be made of flexible rubber. The fabric may be made of leather. There may be elastic bands around the fingers and thumb. A wrist strap may be present, and may releasably attach to the body of the glove using a hook and loop fastener. A shock absorbing insert may be present covering at least a portion of the knuckles of the hand on which the glove is worn. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved protective glove for boxers that has all of the advantages of the prior art hand and wrist stabilization devices and none of the disadvantages.

It is another object of the present invention to provide a new and improved protective glove for boxers that may be easily and efficiently manufactured and marketed.

An even further object of the present invention is to provide a new and improved protective glove for boxers that has a low cost of manufacture with regard to both materials and labor, and which accordingly is then susceptible of low prices of sale to the consuming public, thereby making such protective glove for boxers economically available to the buying public.

Still another object of the present invention is to provide a new protective glove for boxers that provides in the apparatuses and methods of the prior art some of the advantages thereof, while simultaneously overcoming some of the disadvantages normally associated therewith.

Even still another object of the present invention is to provide a protective glove for boxers for protecting a boxer's hand from injury. This allows the user to forgo taping while still protecting the hand.

Still yet another object of the present invention is to provide a protective glove for boxers for protecting a boxer's hand from injury. This makes it possible for the user to apply hand protection without assistance.

An additional object of the present invention is to provide a protective glove for boxers for protecting a boxer's hand from injury. This ensures that the hand protection does not shift and become less effective during a fight.

Lastly, it is an object of the present invention to provide a new and improved protective glove for boxers for protecting a boxer's hand from injury.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
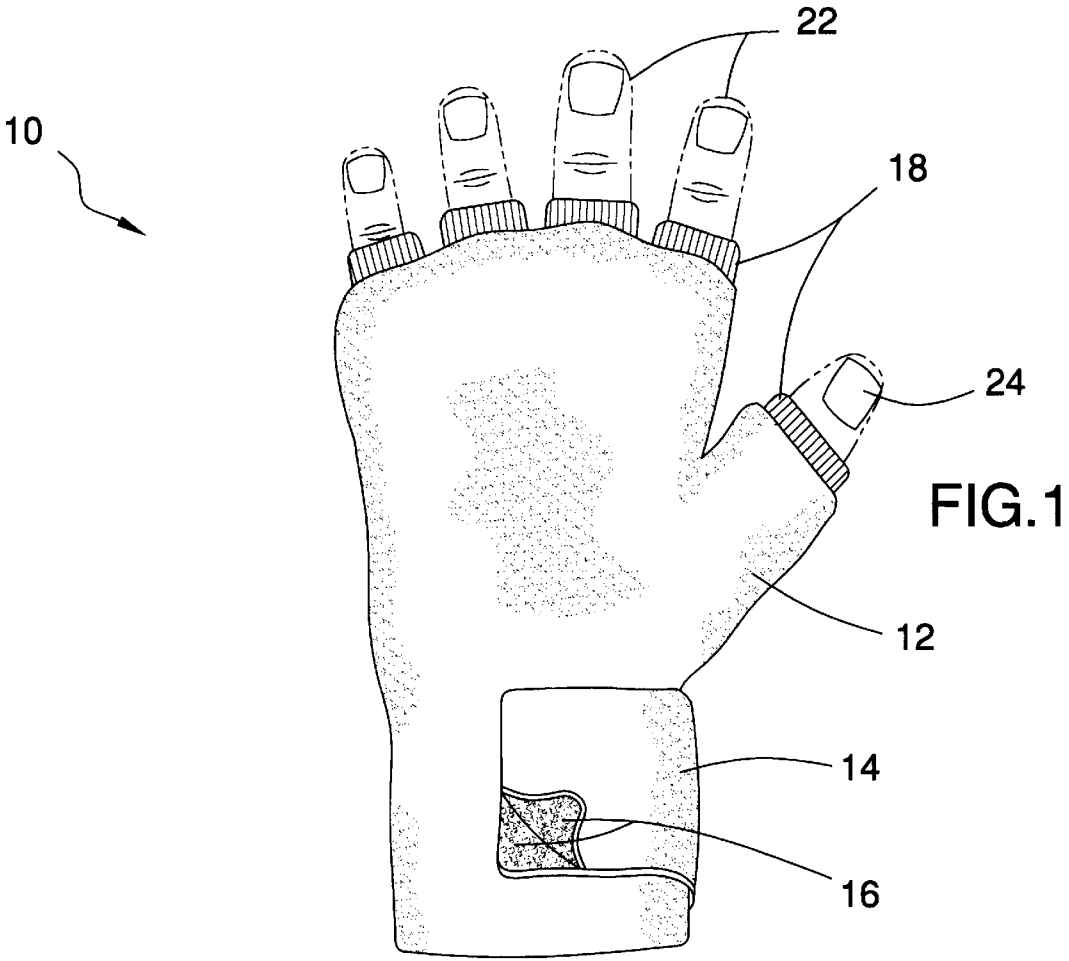
FIG. 1 is a top side view of the current embodiment of the protective glove for boxers constructed in accordance with the principles of the present invention.

Referring now to the drawings, and particularly to FIGS. 1–4, a current embodiment of the protective glove for boxers of the present invention is shown and generally designated by the reference numeral 10.

In FIG. 1, a new and improved protective glove for boxers 10 of the present invention for protecting a boxer's hand from injury is illustrated and will be described. More particularly, the protective glove for boxers 10 has a body 12 made from leather in the current embodiment. Wrist strap 14 is removably secured to body 12 by hook and loop fastener 16. Wrist strap 14 encircles the boxer's wrist and helps secure the protective glove for boxers 10. Elastic bands 18 secure the protective glove for boxers 10 to the fingers 22 and thumb 24. Elastic bands 18 are made from elastic nylon in the current embodiment. Note that the fingers 22 and thumb 24 are for illustrative purposes only and are not part of the current invention.

Figure 2:
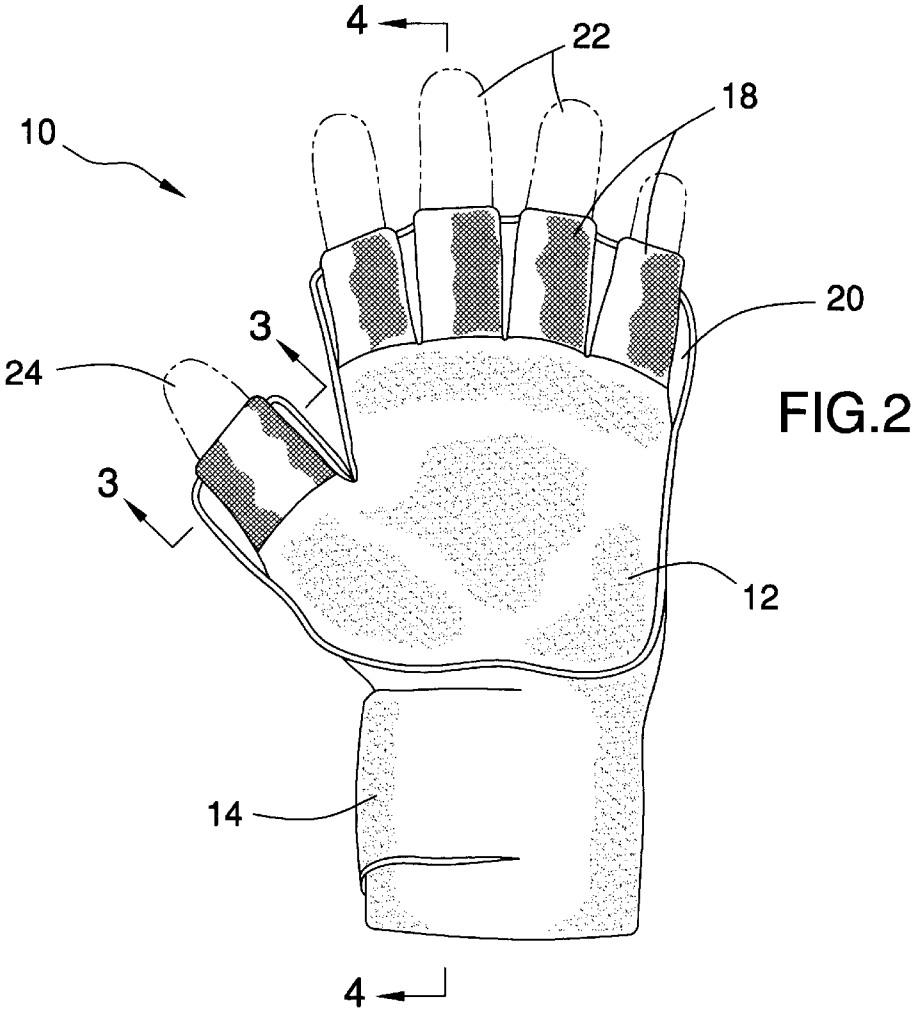
FIG. 2 is a bottom side view of the protective glove for boxers of the present invention.

Moving on to FIG. 2, a new and improved protective glove for boxers 10 of the present invention for protecting a boxer's hand from injury is illustrated and will be described. More particularly, the protective glove for boxers 10 has a body 12. Force dispersion pad 20, made of flexible rubber in the current embodiment, is shown secured to the underside of body 12 over the knuckles and thumb of the boxer's hand. Force dispersion pad 20 disperses the force of impact across the hand, thereby reducing the chance of injury from a concentration of force at a localized point. Elastic bands 18 are shown secured to body 12 and encircling fingers 22 and thumb 24. Wrist strap 14 is also visible. Note that the fingers 22 and thumb 24 are for illustrative purposes only and are not part of the current invention.

Figure 3:
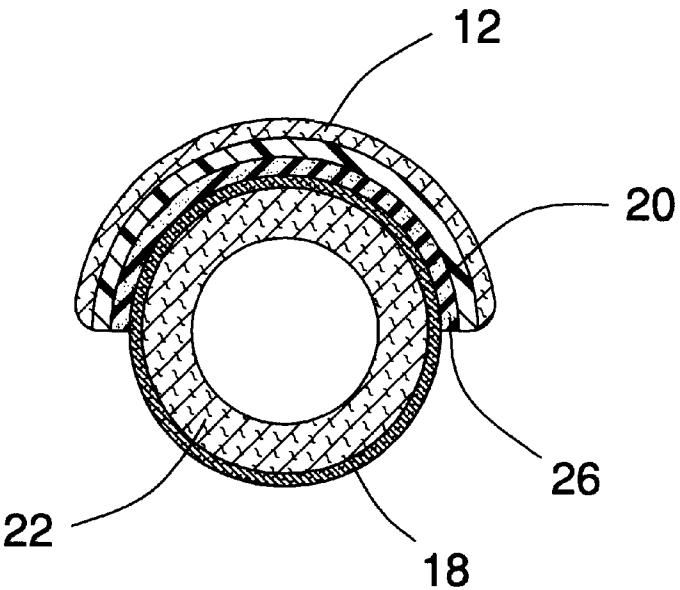
FIG. 3 is a front side sectional view of the protective glove for boxers of the present invention.

Continuing with FIG. 3, a new and improved protective glove for boxers 10 of the present invention for protecting a boxer's hand from injury is illustrated and will be described. More particularly, the body 12 forms the outer layer of the protective glove for boxers 10. Attached to the underside of body 12 is force dispersion pad 20. Attached to the underside of force dispersion pad 20 is shock absorbing insert 26. In the current embodiment, shock absorbing insert 26 is made of cellular foam. The shock absorbing insert 26 dampens the force of impact, thereby reducing the chance of injury from a concentration of force a localized point. Attached to the underside of shock absorbing insert 26, and surrounding finger 22, is elastic band 18. Note that finger 22 is for illustrative purposes only and is not part of the current invention.

Figure 4:
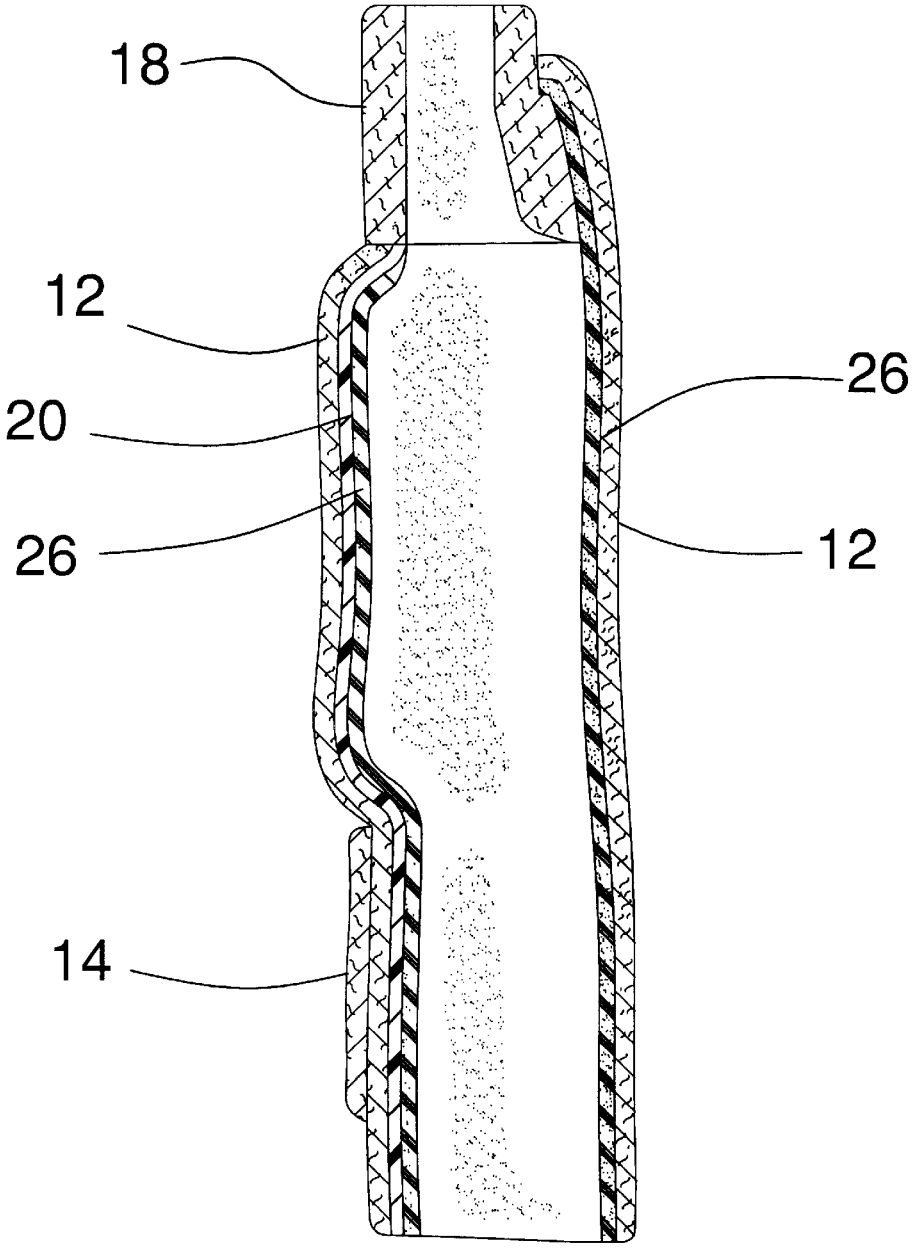
FIG. 4 is a right side sectional view of the protective glove for boxers of the present invention.

Concluding with FIG. 4, a new and improved protective glove for boxers 10 of the present invention for protecting a boxer's hand from injury is illustrated and will be described. More particularly, the finger 22 is encircled by elastic band 18. Attached to the outer layer of elastic band 18 is body 12. Mounted on the underside of body 12 over the knuckles of the hand is force dispersion pad 20. Lining the interior of the protective glove for boxers 10 is shock absorbing layer 26. Wrist strap 14 is also shown removably attached to the outer surface of body 12. Note that finger 22 is for illustrative purposes only and is not part of the current invention.

While a current embodiment of the protective glove for boxers has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable shock absorbing material may be used instead of the cellular foam shock absorbing insert described. Also, the flexible rubber force dispersion pad may also be made of plastic or cellular foam. And although protecting a boxer's hand from injury has been described, it should be appreciated that the protective glove for boxers herein described is also suitable for use in many sports involving impacts to the hands including other martial arts and football. Furthermore, a wide variety of fabrics may be used instead of the leather body described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A protective glove for boxers comprising:

a body formed of flexible fabric for continuous disposition over the wrist, the back and palm of the hand, and a portion of the fingers and thumb, said body having a hand portion and a wrist portion;

a force dispersion pad mounted to said hand portion of said body and extending transversely over the knuckles and a portion of the thumb of a hand on which the glove is worn;

a wrist strap attached to said wrist portion of said body and configured to extend in a circumferential disposition around said wrist portion of said body; and a wrist strap attachment mechanism for releasably retaining said wrist strap in said circumferential disposition.

2. The protective glove for boxers as defined in claim 1, wherein said flexible fabric is made of leather.

3. The protective glove for boxers as defined in claim 1, wherein said force dispersion pad is made of flexible rubber.

4. The protective glove for boxers as defined in claim 1, further comprising a shock absorbing insert mounted to said force dispersion pad and extending transversely over the knuckles and a portion of the thumb of a hand on which the glove is worn.

5. The shock absorbing insert as defined in claim 4, wherein said shock absorbing insert is made of cellular foam.

6. The protective glove for boxers as defined in claim 4, further comprising a finger securing device mounted to said shock absorbing insert and configured to extend in a circumferential disposition around the digits of a hand on which the glove is worn.

7. The finger securing device as defined in claim 6, wherein said finger securing device is a plurality of elastic bands.

8. The wrist strap attachment mechanism as defined in claim 1, wherein said wrist strap attachment mechanism comprises a hook and loop fastener.

9. A protective glove for boxers comprising:

a body formed of flexible fabric for continuous disposition over the wrist, the back and palm of the hand, and a portion of the fingers and thumb, said body having a hand portion and a wrist portion;

a force dispersion pad mounted to said hand portion of said body and extending transversely over the knuckles and a portion of the thumb of a hand on which the glove is worn;

a shock absorbing insert mounted to said force dispersion pad and extending transversely over the knuckles and a portion of the thumb of a hand on which the glove is worn;

a wrist strap attached to said wrist portion of said body and configured to extend in a circumferential disposition around said wrist portion of said body;

a wrist strap attachment mechanism for releasably retaining said wrist strap in said circumferential disposition; and a finger securing device mounted to said shock absorbing insert and configured to extend in a circumferential disposition around the digits of a hand on which the glove is worn.

10. The wrist strap attachment mechanism as defined in claim 9, wherein said wrist strap attachment mechanism comprises a hook and loop fastener.

11. The finger securing device as defined in claim 9, wherein said finger securing device is a plurality of elastic nylon bands.

12. The protective glove for boxers as defined in claim 9, wherein said flexible fabric is made of leather.

13. The protective glove for boxers as defined in claim 9, wherein said force dispersion pad is made of flexible rubber.

14. The shock absorbing insert as defined in claim 9, wherein said shock absorbing insert is made of cellular foam.

15. A protective glove for boxers comprising:

a body formed of flexible fabric for continuous disposition over the wrist and the back and palm of the hand of a user, leaving the fingers and thumb exposed, said body including a hand portion and a wrist portion;

a force dispersion pad mounted to said hand portion of said body and extending transversely over the knuckles and a portion of the thumb of a hand on which the glove is worn;

a shock absorbing insert mounted to said force dispersion pad and extending transversely over the knuckles and a portion of the thumb of a hand on which the glove is worn;

a wrist strap attached to said wrist portion of said body and configured to extend in a circumferential disposition around said wrist portion of said body;

a wrist strap attachment mechanism for releasably retaining said wrist strap in said circumferential disposition; and a finger securing device mounted to said shock absorbing insert and configured to extend in a circumferential disposition around the digits of a hand on which the glove is worn.

16. The wrist strap attachment mechanism as defined in claim 15, wherein said wrist strap attachment mechanism comprises a hook and loop fastener.

17. The finger securing device as defined in claim 15, wherein said finger securing device is a plurality of elastic nylon bands.

18. The protective glove for boxers as defined in claim 15, wherein said flexible fabric is made of leather.

19. The protective glove for boxers as defined in claim 15, wherein said force dispersion pad is made of flexible rubber.

* * * * *